US006185777B1

(12) United States Patent
Siamon

(10) Patent No.: US 6,185,777 B1
(45) Date of Patent: Feb. 13, 2001

(54) SYSTEMS AND METHODS FOR CLEANING

(76) Inventor: Al Siamon, 175 Riverbank La., Paso Robles, CA (US) 93446

( * ) Notice: Under 35 U.S.C. 154(b), the term of this patent shall be extended for 0 days.

(21) Appl. No.: 09/098,170

(22) Filed: Jun. 16, 1998

(51) Int. Cl.[7] ..... B08B 1/02

(52) U.S. Cl. ..... 15/102; 15/21.1; 15/77; 15/88.2; 15/102; 134/64 R

(58) Field of Search ..... 15/21.1, 77, 102, 15/88.2; 134/64 R

(56) References Cited

U.S. PATENT DOCUMENTS 4,504,995 3/1985 Zippwald, Sr. .
4,828,621 5/1989 Siamon .
5,428,856 7/1995 Thorne .

*Primary Examiner*—Randall E. Chin
(74) *Attorney, Agent, or Firm*—Oppenheimer, Wolff & Donnelly LLP; Christopher Darrow

(57) ABSTRACT

Systems and methods for cleaning are provided. The systems encompass a loading area for objects to be cleaned, a sub-system for cleaning each object, a reservoir for holding a cleaning solution formulation consisting of sodium bicarbonate, sodium carbonate and trisodium phosphate in aqueous solution, a sub-system for drying each object and an area for off-loading the objects after cleaning and drying. In some embodiments of the present invention the cleaning sub-system has scrubbing devices for scrubbing objects having surface texture or grooves. In some embodiments of the present invention no scrubbing devices are employed. Methods of the present invention also provide for cleaning surfaces that contact the objects being cleaned during the object's normal use.

12 Claims, 2 Drawing Sheets

SYSTEMS AND METHODS FOR CLEANING

CROSS-REFERENCE TO RELATED APPLICATIONS

A related application entitled "A CLEANING SOLUTION AND METHOD", by the inventor of the present application, U.S. Ser. No. 09/098,042, now pending, is filed concurrently herewith.

BACKGROUND

1. Field of the Invention

The present invention relates to cleaning and, more particularly, to a cleaning solution and cleaning systems that use the cleaning solution.

2. Description of Related Art

Gaming houses, casinos, card clubs and similar commercial ventures use playing cards and chips to conduct games such as Poker, Blackjack, and Baccarat in their everyday business. Due to the increasing popularity of these establishments and the fact that some are open 24 hours a day, seven days a week, a very large number of playing cards and chips are required during the everyday course of business.

Due to wear and tear caused by normal use, the usable life of paper based playing cards is short, requiring frequent replacement. As a result, paper cards are quickly being replaced with more durable plastic cards. These more durable plastic playing cards exhibit increased playing time and hence reduce the cost associated with the frequent replacement of paper cards. However, the benefit gained by this increased playing time is offset by card soiling, as oil and dirt mainly from the players' hands, is transferred to the cards during use. Chips, formed of either a plastic or clay like material, are also frequently soiled due to oil and dirt from players' hands. In addition, playing cards and chips are often soiled by contact with other surfaces, for example the playing surfaces and their surrounds. Often these playing surfaces can shed fibers as the cards and chips are moved. Such fibers then adhere to the cards, chips or other such items often in combination with other contaminants. Often, these contaminants can be detrimental to a person's health if breathed or ingested.

Playing cards and chips have to be kept clean to ensure their proper and effective use. For example, soiled cards or chips can stick to one another causing improper play for the cards, or an error in counting for chips. In addition, playing cards need to be free of markings to ensure that no "marked" cards exist to give certain players an unfair advantage of knowing the value and/or suit of such a "marked" card. Consequently, it is advantageous to clean playing cards and chips regularly.

In the past, playing cards and chips have been cleaned by hand, when cleaned at all. However hand-washing, always inefficient, is also cost prohibitive due to the large number of chips and cards requiring cleaning. The cleaning of chips is particularly laborious due to the textured surface of such chips that provides for the chips stackability. This texture tends to retain more oil and dirt than is commonly found on playing cards.

Recently, automated cleaning systems have become available to replace the hand-washing of playing cards. Examples of such automated cleaning systems directed towards cleaning playing cards are seen in U.S. Pat. No. 4,504,995, entitled "PLAYING CARD CLEANING APPARATUS" to Zippwald, Sr. and in U.S. Pat. No. 5,428,856, entitled "PLAYING CARD CLEANING APPARATUS AND ADJUSTABLE ROLLERS THEREFOR" to Thorne. No automated cleaning system for chips is known.

Both Zippwald and Thorne disclose a playing card cleaning machine which feeds a stack of cards one by one into a series of rollers for sequentially applying cleaning solution, scrubbing, and drying of the individual cards. In Zippwald, a motorized assembly feeds the cards toward a scrubbing means having seven rollers. The cards are then passed to a drying means consisting of roller-driven dual drying belts. In Thorne, cards are fed individually to a scrubbing means consisting of eleven rollers and then toward a drying means consisting of dual drying belts driven by ten rollers.

Both types of card cleaning machines utilize a large number of rollers, which increases the size and complexity of the machines. Furthermore, both Zippwald and Thorne use multiple scrubbing rollers to scrub the card as the card passes between the rollers. The scrubbing of the playing cards by such multiple rollers is required in these cleaning machines as common cleaning solutions are employed. However, the friction of this multiple scrubbing action contributes to wear on the cards thus decreasing the cards useful life.

In both Zippwald and Thorne, the cards are dried by passing them between drying belts in a serpentine pattern. In addition to increasing the size of the cleaning machine, the serpentine belts cause the cards to become sequentially convex and concave as they travel across the rollers driving the belts. Repeated travel through such a drying means can undesirably decrease the rigidity of the cards.

Accordingly, it would be advantageous to have an automated system for cleaning playing cards which overcomes the deficiencies described above with respect to previously known playing card cleaning machines. In addition, it would be advantageous to have an automated system for cleaning chips. It would further be advantageous if such playing card and chip cleaning systems shared design features to enhance the usability and maintainability of such systems by users. In addition, it would be advantageous if both the playing card and chip cleaning systems encompassed a cleaning solution that made possible a simple mechanical design wherein the need for scrubbing rollers, as is the previously known machines, is minimized. It would also be advantageous if the cleaning solution used as part of the cleaning systems could be employed to clean other surfaces that the cards and chips contact, for example the playing surfaces and surrounds. Finally, it would be advantageous if the cleaning solution provided a coating upon drying such that the surfaces cleaned are sealed to allow for increased use and/or extended time between cleanings.

SUMMARY

In accordance with the present invention, an automated cleaning system is provided for cleaning stackable objects. The automated cleaning systems of the present invention encompass a cleaning solution for use with such systems and methods of use thereof. Each automated cleaning system of the present invention has a loading or staging area for holding stackable objects to be cleaned. In addition, each cleaning system has a stackable object cleaning sub-system which further encompasses a cleaning solution wetting device. As will be seen, the cleaning solution wetting device delivers a cleaning solution from a cleaning solution reservoir also contained within the cleaning system. It should be noted that the cleaning solution of the present invention is an integral part of each stackable object cleaning system. Each cleaning system also has a stackable object drying sub-system and a stackable object off-loading or restacking area where the stackable objects are collected after cleaning and drying. In some embodiments in accordance with the present invention, the stackable object cleaning system is configured as an automated playing card cleaning system. In some embodiments the stackable object cleaning system is configured as an automated chip cleaning system.

In accordance with embodiments of the present invention, the cleaning solution of the present invention allows for a design of the mechanical components of the automated cleaning systems not feasible with previously known cleaning solutions. In this manner, the automated cleaning system of the present invention, encompassing both mechanical systems and cleaning solution, can provide more efficient cleaning of playing cards than with the previously mentioned known machines (Zippwald and Thorne). In addition, embodiments of the present invention configured to clean chips, provide for automated chip cleaning which has not hitherto been possible.

In some embodiments, a playing card cleaning system includes a feed roller for transferring individual playing cards from a stack of playing cards into and out of a cleaning solution. Three pairs of essentially co-planar rollers covered with an absorbent material are used for drying the playing cards. The feed roller sequentially transfers cards from the stack into a cleaning sub-system cleaning solution. In some embodiments, the cleaning solution is sprayed onto opposing sides of the cards. As the cards pass through the cleaning sub-system, the cleaning solution of the present invention removes dirt, oil, and other contaminants from the cards on contact. The contaminants removed being advantageously held by the cleaning solution in a manner that prevents redeposit onto subsequent playing cards. The feed roller then transfers the cards to a drying sub-system which can encompass a set of drying rollers. The drying rollers move and dry the cards and then drop the cards into a chute or off-loading area where they are re-stacked.

After the cards are cleaned and dried, a coating or film is left on the cards. The coating has properties that make the cards more resistant to soiling, which increases the use of the cards between cleanings. Furthermore, the coating provides for reduced static build-up and increased lubricity making the cards easier to handle during normal usage. As embodiments of the present invention cards eliminate or reduce the need for scrubbing playing cards, wear and tear on the cards due to such scrubbing is reduced as compared to previously known systems. In addition, absent the large number of scrubbing rollers of the previously known systems, the size and complexity of card cleaning systems of the present invention is reduced. Consequently, smaller, simpler, and more efficient card cleaning systems are provided.

Some embodiments of the present invention are configured to clean chips. In some such embodiments, chips are moved from the loading area and through the system using a cam apparatus rather than feed rollers. In some embodiments, cleaning solution is applied to chips at the cleaning sub-system by and through scrubbing devices. In other embodiments, cleaning solution is applied by a spray system wherein the spray system provides physical cleaning similar to that of scrubbing devices. In some embodiments a combination of scrubbing and spray are employed. In this manner, contaminants present in the ridges and scores, common to chips, are removed. The cam apparatus, by pushing the chips, then transfers the chips to the drying sub-system. In some embodiments the cam apparatus moves the chips through drying rollers where the chips turn the rollers, thus allowing the drying rollers to be free turning. In some embodiments the drying sub-system encompasses motor-driven drying rollers. The drying rollers dry the chips and then drop them into a chute or off-loading area where they are restacked. As mentioned for card cleaning embodiments of the present invention, the cleaning solution of chip cleaning embodiments leaves a coating or film on the surface of each chip after drying. Thus, it has been found that chips cleaned using a chip cleaning system in accordance with the present invention are more resistant to soiling than chips cleaned in other manners. In addition, as was found for cards, the time between cleanings is extended.

In some embodiments of the present invention the cleaning solution is employed to clean surfaces that can contact the objects being cleaned, for example playing surfaces and surrounds. In such embodiments, the cleaning solution so employed leaves a coating on such surfaces upon drying, the coating forming a barrier that resists subsequent soiling and adding lubricity to the surface cleaned thus extending the time between cleaning and the useful life of the surface.

BRIEF DESCRIPTION OF THE DRAWINGS

The present invention may be better understood, and its numerous objects, features, and advantages made apparent to those skilled in the art by referencing the accompanying drawings. For ease of understanding and simplicity, common numbering of elements within the illustrations is employed where an element is the same in different drawings.

DETAILED DESCRIPTION

Figure 1:
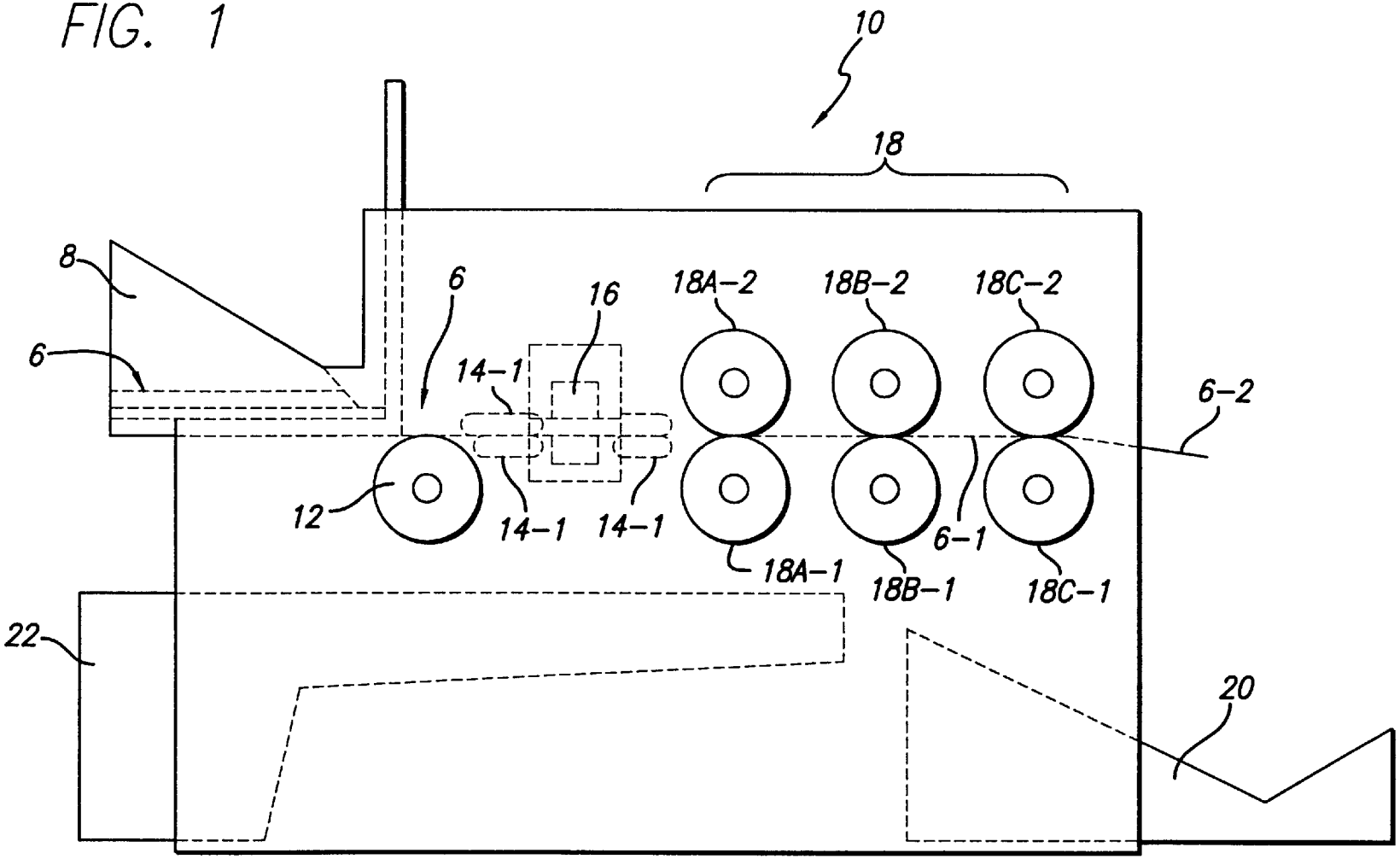
FIG. 1 is a side view of a card cleaning system according to an embodiment of the present invention.

The following is a detailed description of illustrative embodiments of the present invention. As these embodiments of the present invention are described with reference to the aforementioned drawings, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings are not to be considered in a limiting sense as it is understood that the present invention is in no way limited to the embodiments illustrated.

The present invention provides a system for cleaning objects, for example stackable objects such as playing cards, chips, coins and tokens, among others. Each cleaning system encompasses a mechanical sub-system specifically designed to take advantage of the enhanced cleaning properties of the cleaning solution of the present invention. As a result, embodiments of the present invention that are configured for cleaning playing cards are smaller and simpler than previously known card cleaning systems; and embodiments of the present invention configured to clean chips, provide automated chip cleaning not hitherto known.

Each cleaning system embodiment in accordance with the present invention encompasses a cleaning solution formulated for cleaning a specific stackable object. Advantageously, formulating these specific solutions is accomplished by preparing different dilutions of a single basic solution. Thus, in embodiments of the present invention that are for chip cleaning, a solution having a first concentration is employed; in embodiments that are for cleaning playing cards a solution having a second concentration is used, wherein the first concentration is approximately twice the second concentration.

The cleaning solution encompassed in embodiments of the present invention is believed to gain its advantageous properties by employing a specific molar ratio of the above mentioned components. This specific molar ratio is then formulated in aqueous solutions of varying concentrations. Thus embodiments of the present invention are aqueous solutions having various concentrations of a mixture of sodium bicarbonate (hereafter SB), sodium carbonate (hereafter SC) and trisodium phosphate (hereafter TSP) having a molar ratio of approximately 1:2.6:1.6. That is, for every mole of SB, 2.6 moles of SC and 1.6 moles of TSP are used to prepare the cleaning solutions of the present invention. In a typical "full-strength" formulation, an amount of solution having a first concentration is prepared by combining approximately 910 grams of SB, approximately 1,930 grams of SC and approximately 2,270 grams of TSP in approximately 208 liters of water; the water used is either deionized water, softened water or water processed through a reverse osmosis (RO) system. Such a typical "full-strength" formulation of the first concentration is thus approximately 2.46 percent (%) solids or active ingredients. It will be understood that the quantity of "full-strength" cleaning solution described above is illustrative only and that other quantities having the same molar ratio and percent solids concentration can be readily prepared by one of ordinary skill in the art, for example 100 liters of the above "full-strength" solution. In addition, it will be understood that while the specific molar ratio of the above components described has been found to be most effective, other similar molar ratios are also effective. Thus, it has been found that variations of the specific molar ratio of as much as ten percent are still effective and such compositions are within the scope and spirit of the present invention. It has also been found that other solids concentrations for the "full-strength" formulation described above are also effective, for example, concentrations as high as approximately 2.7% and as low as approximately 2.2% are also found to be effective and as such are within the scope and spirit of the present invention.

While "full-strength" formulations are useful as cleaning solutions, other formulations having concentrations less than that of the "full-strength" formulation are also found to be effective cleaners. Thus a formulation having a second concentration is prepared by diluting a "full-strength" solution of the first concentration by approximately one-half. Hence, this "half-strength" formulation has a concentration that is 50% of the first concentration; as a result, such a typical formulation is approximately 1.23% solids. It should be noted that many other dilutions of the "full-strength" cleaning solution can be made and can be advantageously used to clean a wide variety of surfaces and materials; and that often a particular dilution of the "full-strength" formulation is determined by well known empirical methods. All of these alternate dilutions are thus also within the scope and spirit of the present invention. For example, a cleaning solution having a 60% concentration (a 40% dilution of the solution having the first concentration) has advantageously been found to be useful for cleaning playing surfaces and surrounds of gaming tables as found in casinos and the like. Such a typical formulation of the third concentration is approximately 1.48% solids. Finally it will be realized that while each of the aforementioned dilutions have been characterized as dilutions of the "full-strength" solution, any could be made directly by mixing together appropriate amounts of SB, SC and TSP in the proper molar ratio of 1:2.6:1.6, respectively.

While each of the components of the cleaning solution of the present invention is known, the particular mixture of these components, in accordance with embodiments of the present invention, has not hitherto been known. For example, in U.S. Pat. No. 4,828,621 "COMPOSITION AND METHOD FOR ANTI-STATIC PROTECTION" issued May 9, 1989 to this inventor and now abandoned (hereafter '621), a materially different mixture of the present components was presented. In the '621 patent an anti-static solution having a volume ratio of SB:SC:TSP was taught wherein that volume ratio was 1:2:4 to form a solution with a solids content of between 4 to 16 percent. Thus, compared to the cleaning solution of the present invention, the anti-static solution of the '621 patent is formulated with a different ratio of components and having a different concentration of solids to produce different results.

In some embodiments of the present invention, it has additionally been found advantageous to formulate the present cleaning solution in a particular manner. Thus in some embodiments, the appropriate amount of sodium bicarbonate (SB) is added to deionized, softened or RO water and stirred until dissolved. While SB is known to be quite soluble in water, it has been found to be advantageous to add the SB to water that has been warmed to between 30 to 40 degrees Celsius (°C.) to hasten dissolution. Once the SB is dissolved, the appropriate amount of sodium carbonate (SC) is added to the SB solution, again with stirring. Upon addition of the SC, it will be noted that a hazy solution is obtained, and that even after prolonged stirring, the solution does not become fully clear. Finally the appropriate amount of trisodium phosphate (TSP) is added to the mixture of SB and SC, again with stirring. It will be noted that after addition of the TSP, in a sort time (a few minutes) the mixture becomes clear, denoting a true solution of the three components.

One of ordinary skill in the art will realize that other methods of making the cleaning solution of the present invention can be used. For example, the SC can be added to the water as the first step in preparing the cleaning solution. In addition, it is possible to use any one or several of the various hydrated forms of the several components rather than the anhydrous materials specified above. As known, where such hydrated forms are employed, the amount of hydrated material is adjusted to provide the appropriate "anhydrous equivalent weight" needed to obtain the appropriate molar ratio. However, while these other methods of making the cleaning solution are within the scope and spirit of the present invention, the inventor has found it advantageous to prepare the cleaning solution in the manner described above.

Turning to FIG. 1, a side view of a card cleaning system 10 according to one embodiment of this invention is shown. A motor-driven feed roller 12 feeds cards 6 from loading area 8 through card supports 14-1 and 14-2, into a wetting chamber 16, where cards 6 are wetted on both sides with a cleaning solution. The cleaning solution cleans cards 6 on contact. Feed roller 12 continues to feed cards 6 over optional card support 14-3 and towards a set of drying rollers 18. As the cards pass through each pair of drying rollers 18A, 18B and 18C, cards 6 are dried and then fall into a card off-loading area 20, where they are re-stacked for reuse.

Feed roller 12 provides lateral motion to each playing card to feed the cards through to first drying rollers 18A-1 and 18A-2. In some embodiments, feed roller 12 can be rubberized to decrease slippage between feed roller 12 and each of cards 6, which improves the efficiency with which cards 6 are fed. From feed roller 12, each of cards 6 are passed through a gap between two parallel plates 14-1 and 14-2 forming card support 14. Card support 14 maintains each playing card in a substantially horizontal position as it is moved through wetting chamber 16. In some embodiments an optional card support 14-3 is employed to maintain this horizontal position as cards 6 are fed toward drying rollers 18. As the cards pass through wetting chamber 16, the cards are covered with the cleaning solution. In some embodiments of the present invention, cleaning solution is sprayed onto both opposing sides of each playing card. In some embodiments of the present invention, card support 14 is configured to allow the cards to be immersed in the cleaning solution as each card passes through wetting chamber 16. The cleaning solution, which will be described below, cleans the cards by removing contaminants from the card surfaces, typically without the need for scrubbing. Thus, as the cards exit wetting chamber 16, the cleaning solution carrying the contaminants drip into a cleaning solution reservoir 22, thereby leaving the cards free of contaminants. Cleaning solution reservoir 22 thus collects excess solution as well as supplying cleaning solution to wetting chamber 16 for use in cleaning subsequent playing cards.

The lateral motion provided by feed roller 12 then passes the cards to the set of drying rollers 18. In some embodiments of the present invention, lower drying rollers 18A-1, 18B-1 and 18C-1 are motor-driven to provide additional lateral motion and feed playing cards 6 through drying rollers 18 and into card chute 20. Because no other mechanism drives playing cards 6 between feed roller 12 and lower drying rollers 18A-1, 18B-1 and 18C-1, the distance between feed roller 12 and first drying rollers 18A-1 and 18A-2 is less than the length of the cards being cleaned. Furthermore, depending on the width of the gap between parallel plates 14-1 and 14-2, each of playing cards 6 can angle down slightly just before leaving card support 14, i.e., the wider the gap, the larger the downward angle. Consequently, to accommodate different sized playing cards 6, the relative vertical distance between drying rollers 18 and card support 14 is adjusted so that each card contacts enough of the first one of bottom drying rollers 18A-1 and 18A-2 to allow first bottom drying roller 18A-1 to feed the cards through first set of drying rollers 18A-1 and 18A-2.

The cleaned cards then enter a drying sub-system encompassing drying rollers 18 to dry cards 6. While as shown in FIG. 1, card cleaning machine 10 has three sets of drying rollers 18, this is for illustrative purposes only. Hence, other appropriate numbers of drying rollers are also possible. In some embodiments, each set of drying rollers 18 consists of a lower motor-driven roller 18A-1, 18B-1 or 18C-1 and an upper free-turning drying roller 18A-2, 18B-2 or 18C-2. For example, first lower roller 18A-1 contacts first upper roller 18A-2, thereby enabling lower roller 18A-1 to turn upper roller 18A-2 as lower roller 18A-1 is rotated by a motor (not shown). Both lower and upper rollers of drying roller set 18 are covered with a wetness absorbing material, such as chamois or other soft absorbent material. Therefore, as cards 6 enter and contact for example second lower roller 18B-1, lower roller 18B-1 feeds card 6-1 between upper and lower rollers 18B-1 and 18B-2 to dry both sides of the cards.

In the embodiment of the present invention illustrated in FIG. 1, all lower rollers 18A-1, 18B-1 and 18C-1 are motor-driven to provide for moving the cards. It will be understood, however, that this is for illustrative purposes only, and that in other embodiments of the present invention upper rollers 18A-2, 18B-2 and 18C-2 are motor driven and lower rollers 18A-1, 18B-1 and 18C-1 are free-turning. Note that because each lower drying roller 18A-1, 18B-1 and 18C-1 is motor-driven, each set of drying rollers 18A, 18B and 18C can be separated up to a distance slightly less than the length of the cards being cleaned. With the longer distance between roller centers, the drying rollers can be larger in circumference, thereby reducing the frequency of changing the chamois and/or increasing the ability to clean more cards in a single run.

In some embodiments of the present invention, the center or middle set of rollers 18 are not motor-driven, the lateral motion being provided to each playing card by the first and third pair of rollers 18C-1, 18C-2. In such embodiments, the separation between rollers is decreased and the time interval between changing or drying the chamois covering the rollers is shortened. In general, no more than a card length should separate two successive motor-driven rollers, and the last set of drying rollers should be motor-driven to feed the cards completely out of the last set of drying rollers and into card chute or off-loading area 20, where they are re-stacked. Thus, playing card 6-2, after passing through final drying rollers 18C, drops into card off-loading area 20.

As the cleaning solution of embodiments of the present invention cleans playing cards on contact, typically no scrubbing rollers are needed. Thus a smaller and simpler card cleaning machine than those previously known is possible. Furthermore, the cards cleaned according to this invention are not subject to the additional wear and tear from the scrubbing of conventional machines. The cleaning solution also leaves a film of solution on the cards after cleaning and drying. This film makes the cards more resistant to oil, grease, and other contaminants. Consequently, the frequency of card cleaning is reduced.

Figure 2:
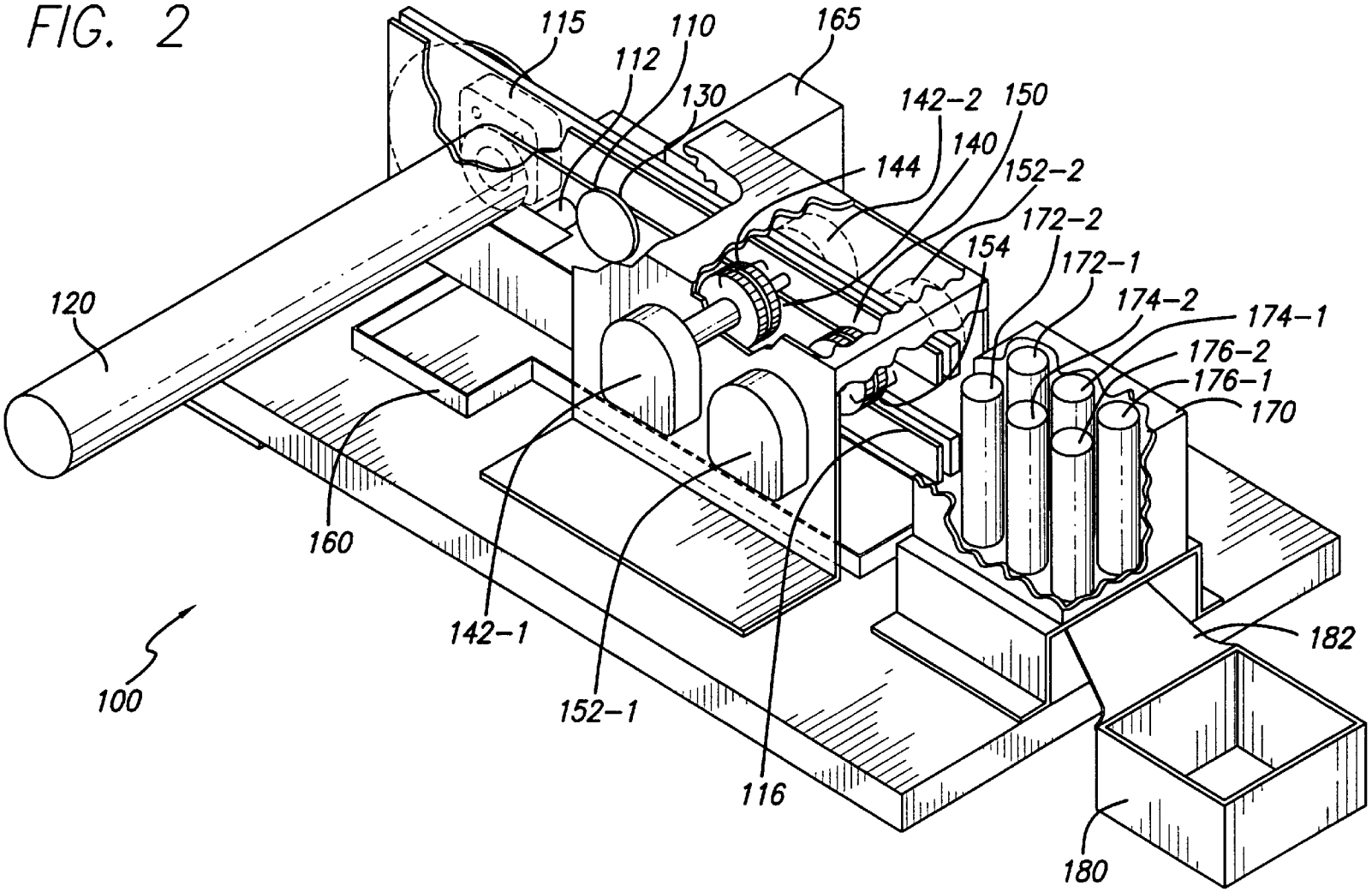
FIG. 2 is a side view of a chip cleaning system according to an embodiment of the present invention.

In FIG. 2, a side view of a chip cleaning system 100 according to an embodiment of this invention is shown. A motorized cam feed sub-system 110, driven by first motor 115, feeds each chip 130 from the chip loading mechanism 120 such that chips 130 are positioned on an edge, as indicated. Cam pushers 112, driven by first motor 115 and part of cam feed sub-system 110, then advantageously push chips 130 along feed track 116 in incremental movements. In this manner, each chip 130 is removed from chip loading mechanism 120 by cam pusher 112 and positioned on track 116. Advantageously, as each chip 130 is removed and pushed onto track 116, a previously positioned chip 130 is pushed forward. Thus chips 130 reach a first scrubbing station 140 and are paused for an interval and then subsequently at a second scrubbing station 150 for another interval. During the intervals where each chip 130 is paused, for example at first and second scrubbing stations 140 and 150, respectively, opposing pairs of brushes 144 and 154 rotatably driven by first brush motors 142-1 and 142-2 and second brush motors 152-1 and 152-2, respectively, scrub opposing sides of each chip 130. Each pair of brush motors 142 and 152 are so configured such that the brushes are rotated in opposing directions. That is to say if first brush motors 142-1 and 152-1 rotate in a clockwise direction, second brush motors 142-2 and 152-2 also rotate in a clockwise direction so that each opposing brush 144 and 154 provides scrubbing to opposite sides of chips 130 without imparting any lateral movement to chips 130 while being scrubbed.

While each chip 130 is being scrubbed, cleaning solution is supplied from a cleaning solution reservoir 160 to a cleaning solution wetting device (not shown). In some embodiments of the present invention, the cleaning solution wetting device provides cleaning solution to both chips 130 and opposing pairs of brushes 144 and 154 at each scrubbing station 140 and 150, respectively. In some embodiments, cleaning solution is provided by the cleaning solution wetting device to only opposing pairs of brushes 144 and 154 which then transfer the solution to chips 130 with scrubbing action. It will be understood, that in this manner, cleaning solution is provided to each opposing side of chips 130 as well as to edges of each chip 130 by opposing pairs of brushes 144 and 154 and/or the cleaning solution delivery sub-system to thoroughly clean chips 130.

Still referring to FIG. 2, after passing through second scrubbing station 150, chips 130 are delivered to drying sub-system 170. As depicted, drying sub-system 170 has three pairs of consecutive drying rollers 172-1 and 172-2, 174-1 and 174-2 and 176-1 and 176-2. It will be understood that in some embodiments of the present invention, drying sub-system 170 is similar to that described with respect to the drying sub-system of card cleaning system 10 depicted in FIG. 1, except that rollers 172, 174 and 176 are oriented vertically while rollers 18A, 18B and 18C of system 10 are oriented horizontally. As described for rollers 18A, 18B and 18C of system 10, rollers 172, 174 and 176 provide lateral motion. Thus in a manner similar to that previously described, chips 130 are both moved through drying sub-system 170 and dried. In some embodiments of the present invention, it has been found advantageous to feed chips 130 through drying sub-system 170 using cam feed sub-system 110. In this manner, rollers 172, 174 and 176 are not driven, and are turned to dry chips 130 by the motion of each chip 130.

Once chips 130 are dried, they fall into collection bin 180 by passing along collection chute 182, both collection bin 180 and chute 182 comprising an off-loading or collection sub-system. As was discussed with respect to system 10 of FIG. 1, the cleaning solution of the present invention leaves a film or coating on the chips after cleaning and drying. This film makes the chips more resistant to oil, grease, and other contaminants. Consequently, the frequency of chip cleaning is reduced.

It will be realized that the systems for cleaning stackable objects such as playing cards and chips that have been described can be alternatively configured for cleaning other stackable objects, for example coins and tokens. Also, it will be understood that the configurations of cleaning systems 10 (FIG. 1) and 100 (FIG. 2) that have been depicted are illustrative only. Thus, other configurations having, for example, alternate wetting stations or numbers of drying rollers are possible and within the scope and spirit of the present invention. Thus, it will be understood that such embodiments for cleaning other stackable objects are within the scope and spirit of the present invention.

It will also be understood that the cleaning action of the cleaning solution prepared in accordance with the present invention can be used to clean and coat other surfaces, for example playing surfaces and surrounds, among other things. Thus as playing cards and chips are soiled by contact with player's hands by the transfer of oils and other materials, contact of the playing cards and chips with the playing surfaces and surrounds also transfer soil and contaminants. Therefore, in some embodiments of the present invention it is advantageous to employ the cleaning solution of the present invention to clean such playing surfaces and surrounds. For cleaning such playing surfaces and surrounds a third concentration of the cleaning solution is employed, the third concentration being prepared from the first concentration by diluting with water to a solids concentration of approximately 1.48 percent. Thus to clean playing surfaces and surrounds, a small amount of cleaning solution of the third concentration is sprayed to lightly wet all the surfaces to be cleaned. The cleaning solution is then distributed using a clean cloth to remove any soil or contaminants present and the surfaces allowed to dry. It has been advantageously found that in addition to cleaning the playing surfaces and surrounds, by and through the coating that is formed upon drying, that the treated playing surfaces and surrounds are resistant to subsequent soiling and have increased lubricity such that the useful life of the playing surfaces are enhanced. In addition, resoiling of playing cards and chips that contact such playing surfaces and surrounds is also reduced.

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as fall within the true spirit and scope of this invention.

What is claimed is:

1. A system for cleaning stackable objects comprising:

a stackable object loading area;

a cleaning solution reservoir;

a stackable object cleaning sub-system, wherein said stackable object cleaning sub-system comprises a cleaning solution wetting device;

a cleaning solution formulation contained within said cleaning solution reservoir, wherein said cleaning solution consists of sodium bicarbonate, sodium carbonate and trisodium phosphate in aqueous solution;

a stackable object drying sub-system; and a stackable object off-loading area.

2. The system of claim 1 wherein said stackable objects are playing cards.

3. The system of claim 2 wherein said cleaning solution wetting device provides cleaning solution to opposing sides of each of said playing cards.

4. The system of claim 3 wherein said cleaning solution has a total per cent solids concentration of less than approximately 1.5 percent.

5. The system of claim 2 wherein said stackable object drying sub-system comprises a pair of drying rollers, each roller of said pair of drying rollers positioned to dry an opposing side of said playing cards.

6. The system of claim 5 wherein one roller of said pair of drying rollers is a mechanically driven roller.

7. The system of claim 1 wherein said stackable objects are chips.

8. The system of claim 7 wherein said stackable object cleaning sub-system comprises no more than one pair of scrubbing devices, each scrubbing device of said pair of scrubbing devices configured to rotatably scrub an opposing side of each of said chips.

9. The system of claim 8 wherein each scrubbing device of said pair of scrubbing devices is mechanically driven to rotate in opposing directions so as to impart essentially no lateral motion to each of said chips.

10. The system of claim 8 wherein said cleaning solution wetting device provides cleaning solution to said pair of scrubbing devices.

11. The system of claim 10 wherein said cleaning solution has a total per cent solids concentration of less than approximately 2.75 percent.

12. The system of claim 8 wherein said stackable object drying sub-system comprises a pair of drying rollers, each roller of said pair of drying rollers positioned to dry an opposing side of each of said chips.

* * * * *